United States Patent [19]

Yamane et al.

[11] 4,210,412

[45] Jul. 1, 1980

[54] METHOD OF TRANSFER PRINTING FOR CELLULOSIC FIBER-CONTAINING TEXTILE PRODUCT

[75] Inventors: Kiyoshi Yamane; Shunzo Abe; Shuzo Sawada; Hatsuo Matsumoto, all of Ootsu, Japan

[73] Assignee: Toyo Boseki Kabushiki Kaisha, Osaka, Japan

[21] Appl. No.: 381,562

[22] Filed: Jul. 23, 1973

[30] Foreign Application Priority Data

Jul. 25, 1972 [JP] Japan ..... 47/74845

[51] Int. Cl.[2] ..... D06P 1/00

[52] U.S. Cl. ..... 8/471; 101/470; 101/473; 250/318

[58] Field of Search ..... 8/2.5; 101/470, 473; 250/318; 117/36.4

[56] References Cited

U.S. PATENT DOCUMENTS

| | | | |
|---|---|---|---|
| 2,040,075 | 5/1936 | Bower | 8/2.5 |
| 3,088,028 | 4/1963 | Newman | 250/318 C |
| 3,653,800 | 4/1972 | Blackwell | 8/21 C |
| 3,706,525 | 12/1972 | Blackwell | 8/173 |

FOREIGN PATENT DOCUMENTS

| | | | |
|---|---|---|---|
| 2045465 | 9/1970 | Fed. Rep. of Germany | 8/2.5 |
| 647105 | 12/1950 | United Kingdom | 8/2.5 |

OTHER PUBLICATIONS

Amer. Dyestuff Rep: Jan. 4, 1965, pp. 26–37.

Fox et al., J. Soc. Dyers & Col., 1969, pp. 612–615.

*Primary Examiner*—Melvyn I. Marquis

*Attorney, Agent, or Firm*—Wenderoth, Lind & Ponack

[57] ABSTRACT

Method of transfer printing for cellulosic textile articles by pretreating the article with a polyhydric alcohol, squeezing and drying the article, superposing the article with a transfer sheet printed with an ink containing a sublimable disperse dye and pressing the assembly under heating.

2 Claims, No Drawings

METHOD OF TRANSFER PRINTING FOR CELLULOSIC FIBER-CONTAINING TEXTILE PRODUCT

The present invention relates to a method of obtaining fast and even color printing of a textile article of cellulosic fiber or a mixture of cellulosic fibers and synthetic or semisynthetic fibers by using a transfer sheet printed with a printing ink containing a sublimable disperse dye.

Methods of transfer printing which comprise printing a pattern on a temporary support such as paper with a printing ink containing a disperse dye, placing the temporary support as a transfer sheet on an article to be transfer-printed and pressing the transfer sheet on the article under heat, are described in U.S. Pat. Nos. 3,363,557 and 3,508,492. However, the articles to be transfer-printed heretofore used have been limited to those of artificial or synthetic polymers such as acetates, polyesters, nylons, polyurethanes, etc. which are dyeable with disperse dyes and have good heat resistance. When the foregoing methods are applied to a textile article consisting of natural fibers or regenerated cellulosic fibers such as cotton, linen or rayon, the article receives substantially no dye or is dyed to a degree of mere staining. Accordingly, when the foregoing conventional methods are applied to a textile article consisting of a mixture of cellulosic fibers and synthetic or semisynthetic fibers, the synthetic or semisynthetic fiber part is dyed but the cellulosic fiber part remains substantially undyed, thus producing a very light or thin color as a whole. Furthermore, it is then almost impossible to obtain a dyed article having a photograph-like sharp-edged and delicate pattern by which these transfer printing methods are characterized. Therefore, such methods have been unsuitable for practical use.

An object of the present invention is to obtain a printed article of a photograph-like sharp-edged and delicate pattern, fast and even in color.

Another object of the invention is to enable the so-called transfer printing method to be applied to a textile article consisting of cellulosic fibers or a mixture of cellulosic fibers and synthetic or semisynthetic fibers thereby to obtain a printed article dyed even and in the same color in both the cellulosic fiber part and synthetic or semisynthetic fiber part.

A further object of the invention is to render the so-called transfer printing method applicable to a woven fabric of loose texture such as lawn, voile or a knit fabric of high extensibility thereby to obtain a printed article of photograph-like sharp-edged and delicate pattern.

The method of the present invention comprises the steps of pretreating a cellulosic fiber-containing textile article with a chemical agent having swelling action on cellulose and having a boiling point not lower than 150° C., for example, a polyhydric alcohol or a derivative thereof, or an aqueous solution or dispersion thereof and drying it; superposing the so pretreated article with a transfer sheet which has been printed beforehand with a printing ink containing a sublimable disperse dye; heating the assembly under pressure to sublime the sublimable dye and condense it onto the cellulosic fiber-containing article and, if required, subjecting the article to an ordinary crosslinking treatment.

The cellulosic fiber-containing textile articles to which the present invention is applicable include yarn, woven fabrics, knit fabrics, paper, non-woven fabrics, etc. composed of cotton, linen, rayon, polynosic rayon, high modulus rayon, etc., and a mixture of cellulosic fibers and synthetic or semisynthetic fibers including blended yarn fabrics, union woven or knit fabrics, blended paper, blended non-woven fabrics, etc. composed of the foregoing cellulosic fibers and synthetic fibers such as modified or non-modified polyester fibers, polyamide fibers, polyacrylonitrile fibers, polyurethane fibers, etc. or semisynthetic fibers such as cellulose diacetate fibers and cellulose triacetate fibers.

In the method of the present invention, the cellulosic fiber-containing article is pretreated with a chemical agent having swelling action on cellulose and having a boiling point not lower than 150° C., for example, a polyhydric alcohol or a derivative thereof, or an aqueous solution or an aqueous dispersion thereof. For instance, a cellulosic fiber-containing article is immersed in an aqueous solution or dispersion containing at least 3 weight percent, preferably 5 to 40 weight percent of the swelling agent, and thereafter squeezing it to a wet pick up of 50 to 100%. Then the article is generally subjected to intermediate drying. The temperature of the intermediate drying depends on the particular swelling agent used but is generally below 120° C. As the method of applying a swelling agent, a spraying or coating method can also be used.

As examples of the swelling agents for cellulose having a boiling point not lower than 150° C. to be used in the present invention can be mentioned the following polyhydric alcohols and derivatives thereof: alkylene glycols such as ethylene glycol, diethylene glycol, triethylene glycol, tetraethylene glycol, dipropylene glycol, tripropylene glycol, butane diol, pentane diol, hexylene glycol, octylene glycol, etc.; alkylene glycol mono- and diethers such as ethylene glycol monomethylether, ethylene glycol monoethylether, ethylene glycol monobutylether, diethylene glycol monoethyl ether, diethylene glycol monobutylether, diethylene glycol dimethylether, diethylene glycol diethylether, diethylene glycol dibutylether, ethylene glycol dibutylether, ethylene glycol isoamylether, ethylene glycol monophenylether, triethylene glycol monomethylether, triethylene glycol monoethylether, propylene glycol monobutylether, dipropylene glycol monomethylether, dipropylene glycol monoethylether, tetrapropylene glycol monomethylether, etc.; alkylene glycol mono- and diesters such as ethylene glycol monoacetate, ethylene glycol diacetate, ethylene glycol formic acid monoester, ethylene glycol formic acid diester, ethylene glycol lactic acid monoester, ethylene glycol propionic acid diester, diethylene glycol monoacetate, diethylene glycol diacetate, propylene glycol monoacetate, propylene glycol diacetate, etc.; alkylene glycol ether esters such as ethylene glycol monomethylether acetate, ethylene glycol monoethylether acetate, diethylene glycol monomethylether acetate, diethylene glycolmonoethylether acetate, diethylene glycol monophenylether acetate, ethylene glycol monohexylether acetate, etc.; polyalkylene glycols such as polyethylene glycol of average molecular weight of 200 to 4000, polypropylene glycol of average molecular weight of 400 to 5000, polyethylene glycol/polypropylene glycol block copolymer of average molecular weight of 400 to 5000, etc.; polyalkylene glycol mono- and diethers such as polyethylene glycol (average molecular weight 200 to 4000) and polypropylene glycol (average molecular weight 400 to 5000) monomethylether, dimethylether, monoethylether, diethylether, monophenylether, monobenzylether, monoglycidylether, diglycidylether, etc.; polyalkylene glycol mono- and diesters such as polyethylene glycol (average molecular weight 200 to 4000) and polypropylene glycol (average molecular weight 400 to 5000) monoacetate, diacetate, etc.; substituted alcohols such as methoxymethoxy ethanol, 1-butoxyethoxy propanol, etc.; polyhydric alcohols such as glycerin, trimethylol propane, polyglycerin (glycidol/glycerin addition product); polyhydric alcohol mono-, di-, triesters such as glycerin monoacetate, diacetate and triacetate; addition products of polyhydric alcohols and alkylene oxides; addition products of polyhydric alcohols and lactones, etc. The most preferred ones among them are polyethylene glycol monoethers such as polyethylene glycol monomethylether (average molecular weight 250 to 1000), polyethylene glycol monoethylether (average molecular weight (250 to 1000), polyethylene glycol monopropylene (average molecular weight 250 to 1000), polyethylene glycol monobutylether (average molecular weight 250 to 1000), etc.

According to the present invention, the pretreated textile article is placed below or superposed with a transfer sheet having been previously printed with a printing ink containing a sublimable disperse dye, and the superposed assembly is heated under pressure to sublime the sublimable dye and condense it onto the textile article. Where the pretreatment agent is a high boiling point agent that cannot be removed by distillation, it is desirable that the pre-treatment agent is removed by water-washing after transfer printing to fix and stabilize the dye on the cellulosic part.

As for the transfer sheet any of conventional or commercial ones having a printed pattern printed with an ink containing a sublimable disperse dye and binder (e.g. methyl cellulose, ethyl cellulose, hydroxypropyl cellulose, hydroxyethyl cellulose, polyvinylpyrrolidone, gelatine, polyvinylalcohol, polyacrylamide, acrylic ester, methacrylic ester or the like) on a temporary support such as paper or film may be used. Since these transfer sheets and preparation thereof are well known in the art no further explanation thereabout will be necessary.

In the present invention, in order to increase the color fastness to washing of disperse dye that has been condensed onto the cellulosic part by sublimation, it is preferable to subject the dyed article to a post treatment with a cross-linking agent. As the cross-linking agents, the following are applicable; dimethylolurea, dimethylolethyleneurea, dimethylolpropyleneurea, dimethyloldihydroxyethyleneurea, partially methoxylated dimethyloldihydroxyethyleneurea, dimethyloluron, trimethylolmelamine, trimethoxymethylmelamine, hexamethoxymethylmelamine, dimethylolmethyltriazone, dimethylolethyltriazone, dimethylolhydroxyethyltriazone, dimethylolmethylcarbamate, dimethylolethylcarbamate, dimethylolhydroxyethylcarbamate, N-methylolacrylamide, 4-methoxy-5-dimethyldimethylolpropyleneurea, glyoxal, formaldehyde, tetraoxane, glutalaldehyde, epoxy compounds, etc. Particularly preferred ones among these are dimethyloldihydroxyethyleneurea and partially methoxylated dimethyloldihydroxyethyleneurea.

The foregoing cross-linking agents may be used according to any of the usual recipes known for cross-linking treatment of cellulose. In this case, a catalyst must also be used. As the catalysts, such compounds can be mentioned as inorganic acids, organic acids, ammonium salts of strong acids, salts of polyvalent metals of strong acids, organic amine hydrochlorides, etc. The most preferable ones are organic amine hydrochlorides. Softners, touch or hand improving agents usually used for the textile treatment may be added to the treating bath.

The cross-linking treatment may be conducted in a conventional manner. Thus for example a cross-linking agent is applied to a textile article in an amount of 1~20%, preferably 2~15% (as solid) by weight based on the textile product. The amount of the catalyst may be 0.1~5%, preferably 0.2~3% (as solid) based on the weight of the textile article. The treatment may be conducted by the so-called pad-dry-cure method, pad-cure method, pad-dry-aging method, etc., although pad-dry-cure method and pad-cure method are preferable. The heat treatment may be conducted at 60°~200° C., preferably at 100°~180° C. for 10 seconds to 30 minutes, preferably for 20 seconds to 10 minutes.

The sublimable disperse dyes are well known in the art, but are desirably those of high hydrophobicity, i.e. low polarity, and having a relatively low molecular weight.

According to the method of the present invention it is possible to dye a cellulosic fiber article which has been heretofore impossible to dye with disperse dyes. It is also possible to dye a textile article composed of cellulosic fibers and synthetic or semisynthetic fibers in an even and same color in both the cellulosic fiber part and synthetic of semisynthetic part. Moreover, one of the characteristic features of the method of the present invention is that good results are also obtained even when the method is applied to a fabric such as lawn or voile, etc. which has been generally unable to be printed because of the loose texture.

Although it is not exactly known why a cellulosic fiber-containing article can be dyed with disperse dyes, a possible supposition is that the cellulosic fibers become swollen in structure to provide dye sites by the pretreatment with a swelling agent and are so modified that the sublimed disperse dye can diffuse into the inside of the cellulosic fibers by the affinity between the swelling agent and the dye. Therefore, inorganic swelling agents having no affinity to the dyes are unsuitable. When the swelling agent is removed after printing, the cellulosic fibers will nearly recover the initial structure and only the highly hydrophobic disperse dye diffused into the inside of the fibers will remain unremoved. This is considered to be the cause of the excellent resistance to washing. Since the method of the present invention is dry type transfer printing, the objects of the invention can be attained by limiting the disperse dyes to be used to only sublimable dyes of high hydrophobicity of course.

The printed articles prepared according to the present invention represent a sharp-edged, delicate pattern and are satisfactory enough to meet the demand of consumers.

The present invention will be explained in further detail by means of the following Examples wherein the parts and percentages are by weight.

EXAMPLE 1

A cotton printcloth (80×80) was immersed in a 15% aqueous solution of polyethylene glycol monomethylether (mol. wt. 300), was squeezed to a wet pick up of 75% and dried at 60° C. for 10 minutes. On the other hand, a sheet of paper for gravure printing (S Bellan M, a product of Tokushu Seishi Co.) was coated with a solution consisting of 90 parts of a mixture of ethyl alcohol/water (1/1) and 10 parts of polyvinyl alcohol so that the coating amount of the polyvinyl alcohol was about 2 g/m$^2$, and then dried. The sheet was then printed on its polyvinyl alcohol-coated surface with a printing ink prepared by dissolving 10 parts of C.I. Disperse Red 60 and 6 parts of ethyl cellulose in a mixed solvent of isopropanol/ethanol (1/1) using a gravure printing machine and was dried to prepare a transfer printing sheet.

The foregoing cotton cloth treated with polyethylene glycol monomethylether (molecular weight 300) was superposed with the transfer sheet and was pressed at 1 kg/cm$^2$ under heating at 200° C. for 30 seconds in a flat plate press to condense and fix the disperse dye on the cotton cloth.

The thus-printed cotton cloth was immersed in an aqueous solution containing 10% dimethylol dihydroxyethyleneurea and 2% 1,3-diaminopropanol hydrochloride (30% aqueous solution) and was squeezed to a wet pick up of 70%. The cotton cloth was then dried at 100° C. for 4 minutes, followed by dry heat treatment at 155° C. for 4 minutes and subjected to water-washing, soaping and drying finish.

The cloth resulted in a printed article dyed even and having good color fastness to washing, which was greatly improved as compared with the conventional untreated cotton printcloth which receives substantially no dye or is dyed to a degree of mere staining.

EXAMPLE 2

A blended yarn cloth of polyester/cotton (65/35) was immersed in a 10% aqueous solution of polyethylene glycol (molecular weight 300), was squeezed to a wet pick up of 75% and dried.

In the same manner as in Example 1, a transfer sheet was prepared and a pattern was transfer-printed on the cloth. The cloth was then immersed in an aqueous solution containing 5% dimethylol dihydroxyethyleneurea and 2% 1,3-diaminopropanol hydrochloride (30% aqueous solution) and squeezed to a wet pick up of 75%. The cloth was then dried at 80° C. for 5 minutes, followed by dry heat treatment at 160° C. for 4 minutes. It was soaped with a solution containing 2 g/l chip soap at 80° C. for 15 minutes, washed with water and dried.

The thus-obtained printed cloth reproduced the pattern of the transfer sheet faithfully and the color fastness to washing was also good.

EXAMPLE 3

A blended fabric of polyester/cotton (65/35) was immersed in a mixed aqueous solution of 10% triethylene glycol and 5% ethylene glycol monoacetate, and after being squeezed to a wet pick up of 75%, it was dried.

In the same procedure as in Example 1, a transfer sheet was produced and a pattern was transferred on the fabric. The fabric was then resin-treated as in Example 2.

The thus-obtained printed fabric was sharp at the pattern edges and faithfully reproduced the pattern of the transfer sheet.

EXAMPLE 4

A blended fabric of polyester/cotton (65/35) was immersed in a mixed aqueous solution of 10% triethylene glycol and 5% ethylene glycol monoacetate. After the fabric was squeezed to a wet pick up of 75%, it was dried. This pretreated blended fabric was placed under a transfer sheet prepared in the same manner as in Example 1 except that C.I. Disperse Yellow 8 was used as the dye and was pressed under heating as in Example 1. Immediately after this, it was washed with water and dried, and resin-treated as in Example 2.

The thus-obtained printed product reproduced the pattern of the transfer sheet faithfully, both the polyester part and the cotton part being dyed even and in the same color. The color fastness to washing was good.

EXAMPLE 5

A woven fabric of 100% cotton was immersed in an aqueous solution containing 15% triethylene glycol and 15% ethylene glycol monoacetate. After the fabric was squeezed to a wet pick up of 80%, it was dried at 80° C. for 5 minutes.

This pretreated cotton fabric was placed under a transfer sheet of Example 4 and pressed at 1 kg/cm$^2$ under heating at 210° C. for one minute in a flat plate press to transfer a pattern onto the cotton fabric. Thereafter, the fabric was treated with resin according to the procedure in Example 1.

On the other hand, a 100% polyester woven fabric was placed below the same transfer sheet and was subjected to pressure and heat under the same condition as in the case of the 100% cotton fabric.

The thus-obtained printed 100% cotton woven fabric and the printed 100% polyester woven fabric were of the same color. The color fastness to washing was also good.

EXAMPLE 6

A union cloth obtained by using polyester false twisted yarn as warp and blended yarn of polyester/rayon (65/35) as weft, was immersed in a 10% aqueous solution of polyethylene glycol (molecular weight 300) and after being squeezed to a wet pick up of 80%, it was dried at 100° C. for 10 minutes. This pretreated fabric was superposed with a transfer sheet of Example 4 and pressed at 1 kg/cm$^2$ under heating at 210° C. for one minute in a flat plate press to transfer a pattern onto the fabric, which was then washed with water and dried. This transfer-printed fabric was immersed in an aqueous solution containing 4% dimethylol ethyleneurea and 2% 1,3-diaminopropanol hydrochloride (30% aqueous solution). After the fabric was squeezed to a wet pick up of 70%, it was dried at 100° C. for 4 minutes, followed by dry heat treatment at 140° C. for 5 minutes. The fabric was then subjected to rinsing, soaping and drying finish.

The thus-obtained printed union fabric reproduced the pattern of the transfer sheet faithfully and both the polyester part and cotton part assumed the same color. Both color fastness to washing and color fastness to rubbing were good.

EXAMPLE 7

A blended fabric of polyester/cotton (65/35) was immersed in a 10% aqueous solution of polyethylene glycol monomethylether (molecular weight 340). After being squeezed to a wet pick up of 75%, the fabric was dried. By using the group of dyes (conc. cake) shown in Table 1, heat transfer sheets respectively containing the dyes were prepared in the same procedure as in Example 1. Transferring, water-washing and drying were carried out in the same way as in Example 1.

The thus-obtained printed products were divided in two groups. The one was treated with resin as in Example 2 and the other, without resin treatment, was soaped at 60° C. with a solution containing 2 g/l chip soap. The result was that the printed products without resin treatment lost almost all dye from the cotton part and could not retain the sharp pattern, while on the other hand the resin-treated printed products represented no substantial falling-off of dye and retained a sharp pattern, even after soaping under the same condition.

Table 1

| | |
|---|---|
| C.I. Disperse Yellow 1 | C.I. Disperse Red 17 |
| C.I. Disperse Yellow 3 | C.I. Disperse Red 60 |
| C.I. Disperse Yellow 8 | C.I. Disperse Violet 1 |
| C.I. Disperse Yellow 9 | C.I. Disperse Violet 4 |
| C.I. Disperse Yellow 23 | C.I. Disperse Violet 12 |
| C.I. Disperse Yellow 42 | C.I. Disperse Blue 1 |
| C.I. Disperse Yellow 60 | C.I. Disperse Blue 3 |
| C.I. Disperse Orange 3 | C.I. Disperse Blue 5 |
| C.I. Disperse Orange 15 | C.I. Disperse Blue 14 |
| C.I. Disperse Red 1 | C.I. Disperse Blue 19 |
| C.I. Disperse Red 9 | C.I. Disperse Blue 24 |
| C.I. Disperse Red 11 | C.I. Disperse Blue 26 |
| C.I. Disperse Red 15 | C.I. Disperse Blue 71 |

EXAMPLE 8

A cotton broadcloth of No. 40 count yarn was immersed in a 20% aqueous solution of polyethylene glycol (molecular weight 300), and after being squeezed to a wet pick up of 75%, it was dried at 80° C. for 5 minutes.

On the other hand, a transfer sheet was prepared in the same procedure as in Example 1 by using a disperse dye of the formula:

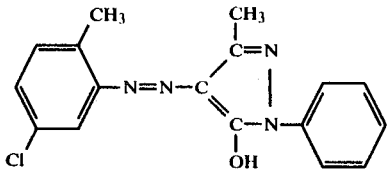

The foregoing cloth pretreated with the swelling agent was superposed with the transfer sheet and was pressed at 1 kg/cm$^2$ under heating at 210° C. for 30 seconds. Immediately after this, the cloth was washed with water and dried to condense and fix the disperse dye in the inside of the fibers. The thus-obtained printed product assumed a clear yellow color and was excellent in both color fastness to sunlight and color fastness to washing, so that resin treatment could be omitted.

EXAMPLE 9

A sheeting of polyester/cotton (65/35) was immersed in a 10% aqueous solution of polyethylene glycol monophenylether (molecular weight 420). After the cloth was squeezed to a wet pick up of 80%, it was dried.

On the other hand, a transfer sheet was prepared in the same procedure as in Example 1 by using a disperse dye of the formula:

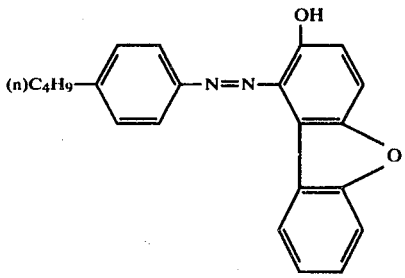

The cloth pretreated with the swelling agent was placed below the transfer sheet and pressed at 1 kg/cm$^2$ under heating at 200° C. for 30 seconds in a flat plate press. Immediately after this, the cloth was washed with water and dried.

The thus-obtained printed product assumed a yellow color and was excellent in level dyeability, color fastness to sunlight and color fastness to washing and did not require resin treatment.

EXAMPLE 10

A blended yarn fabric of polyester/cotton (65/35) was immersed in a 10% aqueous solution of polyethylene glycol (molecular weight 300). After the fabric was squeezed to a wet pick up of 80%, it was dried at 120° C. for 2 minutes.

On the other hand, a sheet of gravure printing paper (S Bellan M; Tokushu Seishi Co.) was printed with an aqueous paste consisting of 10 parts of a 20% liquid of a disperse dye of the formula:

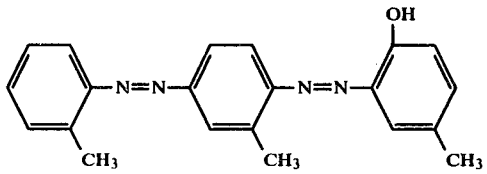

60 parts of 80% Mayprogum CR (Sansho Co.) and 30 parts of water through a 120 mesh flat screen so that the wet pick up amount was 100%, and was dried. The swelling agent-pretreated fabric was then placed under the transfer sheet and was pressed at 1 kg/cm$^2$ under heating at 200° C. for 30 seconds, immediately followed by water-washing and drying.

The thus-obtained printed product assumed an orange color and was excellent in level dyeability, color fastness to sunlight, color fastness to washing, etc., thus requiring no resin treatment.

EXAMPLE 11

A lawn cloth consisting of polyester/cotton (65/35) was immersed in a 10% aqueous solution of polyethylene glycol (molecular weight 600). After the cloth was squeezed to a wet pick up of 90% it was dried.

On the other hand, a transfer sheet was prepared in the same way as in Example 10 by using a disperse dye of the formula:

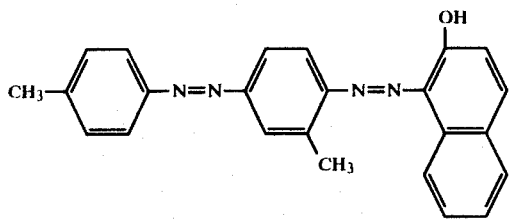

The foregoing swelling agent-pretreated cloth was placed under the transfer sheet and pressed in a flat plate press at 1 kg/cm$^2$ under heating at 210° C. for 30 seconds, immediately followed by water-washing and drying.

The thus-obtained printed product was red in color and excellent in color fastness to washing.

EXAMPLE 12

A polyester/cotton sheeting (25/75) was immersed in a 20% aqueous solution of polyethylene glycol monobutylester (molecular weight 360). It was then squeezed to a wet pick up of 80% and dried.

On the other hand, a transfer sheet was prepared by the same procedure as in Example 1 by using a disperse dye of the formula:

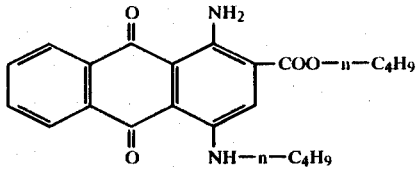

The foregoing cloth treated with the swelling agent was placed under this transfer sheet and pressed in a flat plate press at 1 kg/cm$^2$ under heating at 210° C. for 30 seconds, immediately followed by water-washing and drying.

Thereafter, the cloth was treated with an aqueous solution consisting of 5 parts of a 50% aqueous solution of 1,3-dimethoxymethyl-4,5-dihydroxyethyleneurea, 2 parts of a 30% aqueous solution of 1,3-diaminopropanolamine hydrochloride, 2 parts of a 20% emulsion of polyethylene and 91 parts of water. After the cloth was squeezed to a wet pick up of 75%, it was dried at 80° C. for 5 minutes and heated at 160° C. for 5 minutes, followed by soaping and drying.

The thus-obtained printed product was in an even blue color both in the polyester part and cotton part and was excellent in color fastness to washing and color fastness to wet friction.

EXAMPLE 13

A blended fabric of nylon/rayon (50/50) was immersed in a 15% aqueous solution of triethylene glycol. After the fabric was squeezed to a wet pick up of 100%, it was dried at 60° C. for 10 minutes.

This pretreated fabric was placed under a transfer sheet of Example 1 and was subjected to heat treatment under pressure and resin treatment in the same way as in Example 1.

The thus-obtained printed product reproduced the pattern of the transfer sheet with complete fidelity, and both the nylon part and the cotton part were dyed even in the same color. The color fastness to washing was also good.

EXAMPLE 14

A blended fabric consisting of cationic-dyeable polyester (fibers produced by melt-spinning of polyethylene terephthalate copolymerized with 2.3 mol percent 5-sulfo-isophthalic acid dimethylester)/cotton (65/35) was immersed in a 7.5% aqueous solution of polyethylene glycol monoethylether (mol. wt. 350). After the fabric was squeezed to a wet pick-up of 75%, it was dried at 80° C. for 5 minutes.

This pretreated fabric was superposed with a transfer sheet of Example 1 and was subjected to heat and pressure treatment in the same way as in Example 1.

The thus-obtained printed product reproduced the pattern of the transfer sheet with high fidelity and was dyed even and in the same color in both the cationic-dyeable polyester part and the cotton part. The color fastness to washing was also good.

EXAMPLE 15

A blended fabric of cellulose triacetate/cotton (65/35) was pretreated with the swelling agent in the same way as in Example 14. This pretreated fabric was superposed with a transfer sheet of Example 1 and was pressed at 4 kg/cm$^2$ under heating at 195° C. for 30 seconds. After the transferring, the fabric was treated with resin in the same way as in Example 1.

The thus-obtained printed product reproduced the pattern of the transfer sheet with high fidelity and was dyed even and in the same color in both the cellulose triacetate part and the cotton part. The color fastness to washing was also good.

What is claimed is:

1. A method of transfer printing for a cellulosic fiber-containing textile article which comprises pretreating the article with a 5–40 weight % aqueous solution of dispersion of a swelling agent selected from the group consisting of alkylene glycols, alkylene glycol mono- and di-ethers, alkylene glycol mono- and di-esters, alkylene glycol ether esters, polyalkylene glycols having an average molecular weight of 200–5000, polyalkylene glycol mono- and di-ethers having an average molecular weight of 200–5000 and polyalkylene glycol mono- and di-esters having an average molecular weight of 200–5000, all having a boiling point not lower than 150° C., squeezing the pretreated article to a wet pick-up of 50–100%, subjecting the squeezed article to drying at a temperature below 120° C., superposing the dried article with a transfer sheet printed with an ink containing a sublimable disperse dye having a molecular weight no greater than 394, pressing the resultant assembly under heating to transfer the dye of the transfer sheet onto the article and subjecting the dyed article to a cross-linking treatment in a bath containing a cross-linking agent and a catalyst.

2. The method according to claim 1 further comprising washing and drying the dyed article before the cross-linking treatment.

* * * * *